US010232494B2

(12) United States Patent
Yang

(10) Patent No.: US 10,232,494 B2
(45) Date of Patent: Mar. 19, 2019

(54) RATCHET WRENCH

(71) Applicant: Cheng-Pu Yang, Taichung (TW)

(72) Inventor: Cheng-Pu Yang, Taichung (TW)

( * ) Notice: Subject to any disclaimer, the term of this patent is extended or adjusted under 35 U.S.C. 154(b) by 233 days.

(21) Appl. No.: 15/465,615

(22) Filed: Mar. 22, 2017

(65) Prior Publication Data

US 2018/0272504 A1 Sep. 27, 2018

(51) Int. Cl.
*B25B 13/46* (2006.01)

(52) U.S. Cl.
CPC ..... *B25B 13/463* (2013.01)

(58) Field of Classification Search
CPC ..... B25B 13/463
See application file for complete search history.

(56) References Cited

U.S. PATENT DOCUMENTS 6,629,477 B2 * 10/2003 Ling ..... B25B 13/463 81/63
6,647,832 B2 * 11/2003 Hu ..... B25B 13/463 192/43.1
6,860,175 B2 * 3/2005 Hu ..... B25B 13/463 81/58.1
6,918,323 B2 * 7/2005 Arnold ..... B25B 13/463 81/63
6,935,213 B2 * 8/2005 Shu-Sui ..... B25B 13/463 81/63
6,966,241 B2 * 11/2005 Huang ..... B25B 13/463 192/43.2
6,971,287 B2 * 12/2005 Lee ..... B25B 13/463 81/60
7,263,919 B2 * 9/2007 Arnold ..... B25B 13/463 81/60
7,278,339 B2 * 10/2007 Hu ..... B25B 13/463 81/63
7,938,043 B2 * 5/2011 Hu ..... B25B 13/463 81/63
9,409,284 B2 * 8/2016 Sun ..... B25B 13/463
9,440,336 B2 * 9/2016 Liu ..... B25B 13/463
9,545,705 B2 * 1/2017 Hu ..... B25B 13/463
9,815,179 B2 * 11/2017 Anderson ..... B25B 13/463
10,105,828 B2 * 10/2018 Wang ..... B25B 13/463
2015/0352697 A1 * 12/2015 Yang ..... B25B 13/463 81/63.2
2016/0167203 A1 * 6/2016 Chen ..... B25B 13/463 81/63.1
2018/0200870 A1 * 7/2018 Shih ..... B25B 23/0007

* cited by examiner

*Primary Examiner* — David B. Thomas

(57) ABSTRACT

A ratchet wrench includes a body with a ratchet wheel, a pawl and a switch unit connected thereto. The pawl has a toothed portion on the front side thereof, and a concaved area in the rear side thereof. A first face and two second faces are defined in the concaved area. The first face is located between the two second faces. Each of two sidewalls of the concaved area has a third face. An engaging recess is defined between the second and third faces on the same side relative to the first face. The switch unit controls the pawl to move to engage the toothed portion of the pawl with the ratchet portion of the ratchet wheel so as to control the rotational operations of the ratchet wrench.

8 Claims, 7 Drawing Sheets

RATCHET WRENCH

BACKGROUND OF THE INVENTION

1. Fields of the Invention

The present invention relates to a ratchet wrench, and more particularly, to a ratchet wrench for precisely positioning the pawl relative to the ratchet wheel.

2. Descriptions of Related Art

One of the conventional ratchet wrench known to applicant is disclosed in U.S. Pat. No. 8,291,792 which discloses a ratchet wrench and comprises a main body having a handle at one end and a function end at the other. The function end has a round first housing opened in its middle. The wall of the first housing is a curved second housing. Both the top and the bottom portions of the second housing are confined. A ratchet wheel is rotatably mounted in the first housing, and the outer periphery of the ratchet wheel includes a plurality of ratchet teeth annularly arranged at its middle portion. A pawl is lodged in the second housing and has a plurality of first retaining cogs. A plurality of curved second retaining cogs and a first concave surface are successively arranged on its front side and distributed along a first arc which has the same diameter as the first housing. The first retaining cogs and the second retaining cogs are defined to engage with the ratchet teeth. The tips of the first retaining cogs distribute on a third arc and the tips of the second retaining cogs distribute on a fourth arc. At least two teeth of the first retaining cogs pass a bisector of the first arc and are followed by the second retaining cogs as the pawl and the ratchet wheel are effectively engaged together. The central angle of the second retaining cogs extends along the first arc is less than or equal to 20 degrees. A first convex surface is defined on the rear side of the pawl and has a first end and a second end defined in opposite directions. The first end extends a second convex surface towards the front side of the pawl and the second end extends a recess. The second convex surface spans a central angle N2 with respect to the center of the first arc. The second convex surface is on a second arc and against the wall of the second housing. The second arc has the same diameter as the second housing. Between the second arc and the second end of the first convex surface is a gap which is larger than the depth of the first retaining cog. The recess is corresponding to the second retaining cogs. A normal extends from the middle of the bottom of the recess passing through the center of the second arc, and the normal and the bisector of the first convex surface has an included angle N3. An elastic element has a first end and a second end. The outer diameter of the first end is greater than or equal to the vertical depth of the second housing in order for the first end to be held against the second housing and for the second end to be held within the recess. The elastic element pushes the pawl so that the second convex surface is forced to abut against the wall of the second housing and the first retaining cogs of the pawl are engaged with the ratchet teeth.

However, the pawl includes multiple first retaining cogs and multiple first concave surfaces. The first retaining cogs are engaged with the ratchet teeth of the ratchet wheel, and the first concave surfaces are engaged with one side of the first retaining cogs. The first concave surfaces restrict the ratchet wrench to be operated only in one direction and cannot be functionally operated in two different directions.

The present invention intends to provide a ratchet wrench that is designed to eliminate the shortcomings mentioned above.

SUMMARY OF THE INVENTION

The present invention relates to a ratchet wrench which comprises a body with a ratchet wheel, a pawl and a switch unit connected thereto. The pawl has a toothed portion on the front side thereof, and a concaved area in the rear side thereof. A first face and two second faces are defined in the concaved area. The first face is located between the two second faces. Each of two sidewalls of the concaved area has a third face. An engaging recess is defined between the second and third faces on the same side relative to the first face. The switch unit controls the pawl to move to engage the toothed portion of the pawl with the ratchet portion of the ratchet wheel so as to control the rotational operations of the ratchet wrench.

The primary object of the present invention is to provide a ratchet wrench wherein the pawl includes a concaved area in the rear side thereof, and a first face, two second faces, two third faces and two engaging recesses are defined in the concaved area. The two second faces, the two third faces and the two engaging recesses are symmetrical to the first face. The switch unit controls the cap to be engaged with one of the engaging recesses so as to effectively control the rotational operations of the ratchet wrench. The cap is biased by the resilient member and restricted by the engaging recesses so that the switch unit is not separated from the body. The cap is further restricted by the protrusion extending from the concaved area and faces the middle of the pawl to ensure that the pawl is perfectly engaged with the ratchet wheel.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
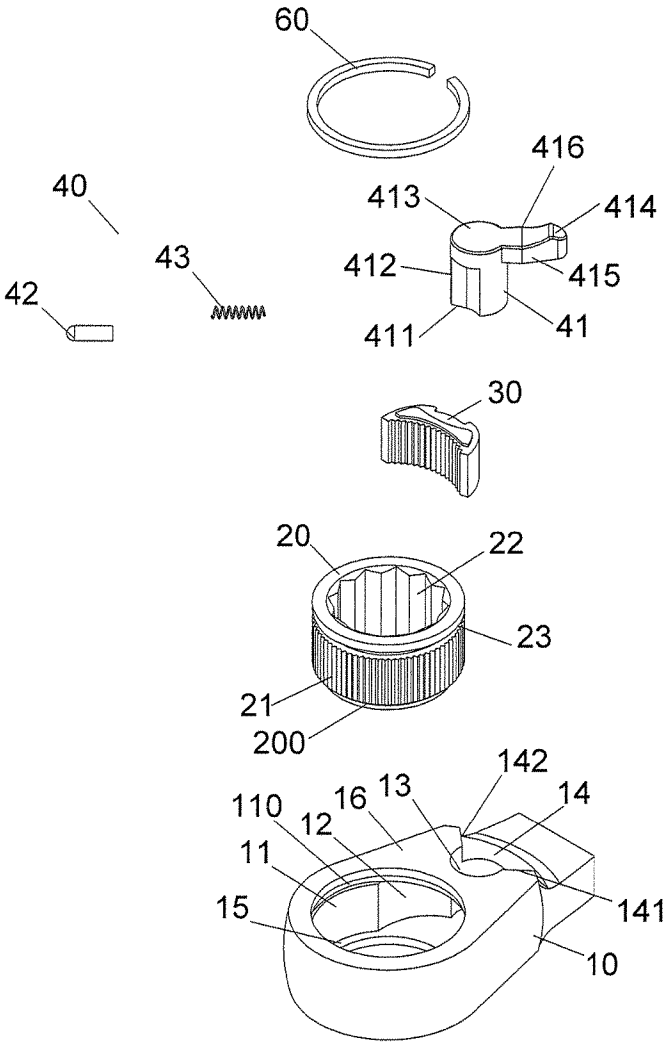
FIG. 1 is an exploded view of the ratchet wrench of the present invention.
Figure 2:
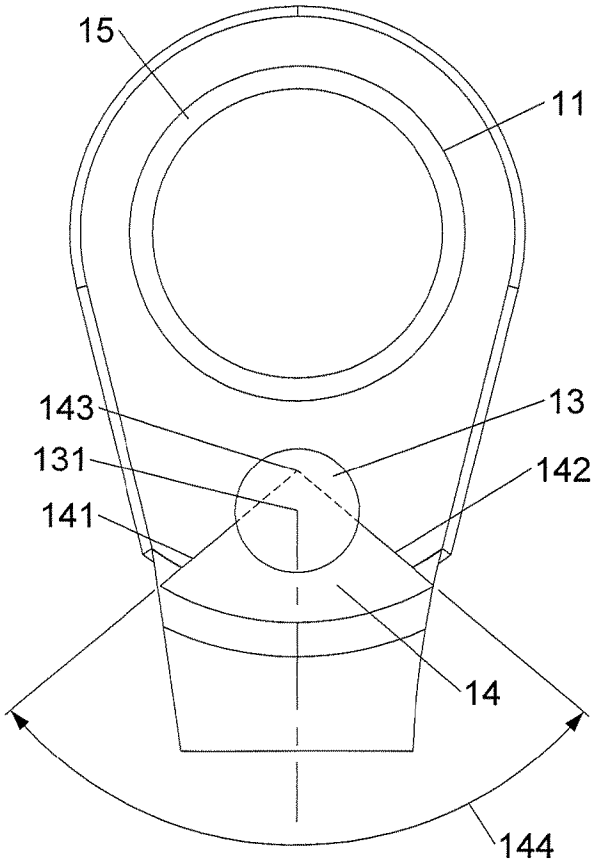
FIG. 2 is a top view to show the body of the ratchet wrench of the present invention.
Figure 4:
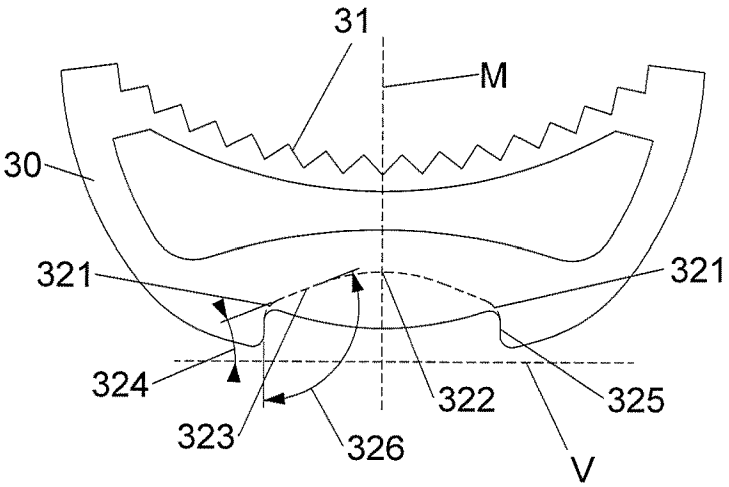
FIG. 4 is a top view to show the pawl of the ratchet wrench of the present invention.

Referring to FIGS. 1 to 4, the ratchet wrench of the present invention comprises a body 10, a ratchet wheel 20, a pawl 30, a switch unit 40, and a clip 60. The body 10 has a through hole 11 defined therethrough, and a first recess 12 is defined in the inner periphery of the through hole 11. A first groove 110 is defined in the upper portion of the inner periphery of the through hole 11. A flange 15 extends radially from the lower portion of the inner periphery of the through hole 11. A second recess 13 is defined in the inner periphery of the first recess 12 and is smaller than the first recess 12. The second recess 13 communicates through the first top face 16 of the body 10. A recessed area 14 is defined in the first top face 16 of the body 10, and includes a first contact face 141 and a second contact face 142 on two sides thereof. Assume that each of the first and second contact faces 141, 142 has an extension line, and the two extension lines intersect at a point 143 which is located closer than the center of the second recess 13 to the second recess 13 and the through hole 11. An angle 144 of 60 to 100 degrees is defined between the first and second contact faces 141, 142. The first top face 16 of the body 10 is a flat face.

The ratchet wheel 20 is rotatably received in the through hole 11 and has a ratchet portion 21 defined in the outer periphery thereof. The ratchet wheel 20 has a connection portion 22 which is adapted to be connected to an object such as a bolt or a nut. The ratchet wheel 20 has a second groove 23 defined in the outer periphery of the upper portion thereof. A positioning portion 200 is formed on the underside of the ratchet wheel 20, and the positioning portion 200 is a tubular portion extending from the underside of the ratchet wheel 20. The diameter of the tubular portion is smaller than the diameter of the ratchet wheel 20, and a shoulder is formed between the tubular portion and the underside of the ratchet wheel 20, the shoulder contacts the flange 15.

The pawl 30 is movably received in the first recess 12. The pawl 30 has a toothed portion 31 defined in the front side thereof, and the toothed portion 31 is engaged with the ratchet portion 21 of the ratchet wheel 20. A U-shaped concaved area 32 is defined in the rear side of the pawl 30. The concaved area 32 includes a first face 322 defined in the inner periphery thereof. The first face 322 is located between two second faces 323 which are symmetrical to the first face 322 and tangent to the first face 322. The concaved area 32 has two sidewalls and each sidewall has a third face 325. The first face 322 is located between two third faces 325 which are symmetrical to the first face 322. An engaging recess 321 is defined between the second face 323 and the third face 325 on the same side relative to the first face 322. A first angle 324 of 15 to 25 degrees, preferably 20 to 24 degrees, defined between the second face 323 and a first plane "V" that is perpendicular to a second plane "M" that passes through the middle point of the first face 322 and bisects the first face 322. A second angle of 100 to 120 degrees, preferably 110 to 114 degrees, is defined between the second face 323 and the third face 325 on the same side relative to the first face 322. A protrusion 33 extends from the inner end of the concaved area 32 and includes a flat underside 34. The width 36 of the protrusion 33 is smaller than a half of the width 35 of the pawl 30, The switch unit 40 includes a switch member 41 which is inserted into the second recess 13. A cap 42 and a resilient member 43 are received in the switch member 41. The cap 42 is biased by the resilient member 43 and engaged with one of the engaging recesses 321 to move the pawl 30 to either one of two ends of the first recess 12 to be engaged with the ratchet portion 21 to control rotational operation of the ratchet wrench.

The switch member 41 has a cylindrical portion 411 which has a restriction recess 412 which faces the concaved area 32 of the pawl 30. The switch member 41 includes a flat second top face 413 which is in flush with the first top face 413 of the body 10. A lever 414 extends from the switch member 41 and located in the recessed area 14. The lever 414 has a third contact face 415 and a fourth contact face 416 on two sides thereof. When pivoting the lever 414 to move the third contact face 415 or the fourth face 416 to contact the first contact face 141 or the second contact face 142, the cap 42 is biased by the resilient member 43 to contact the concaved area 32. The outer periphery of the cap 42 contacts the flat underside 34. The cap 42 is restricted by the width 36 of the protrusion 33 so as to make the cap 42 face the middle of the pawl 30. That is to say, the cap 42 is located corresponding to the middle of the width 35.

The clip 60 is a resilient clip and received between the first groove 110 and the second groove 23 to rotatably locate the ratchet wheel 20 in the through hole 11.

Figure 5:
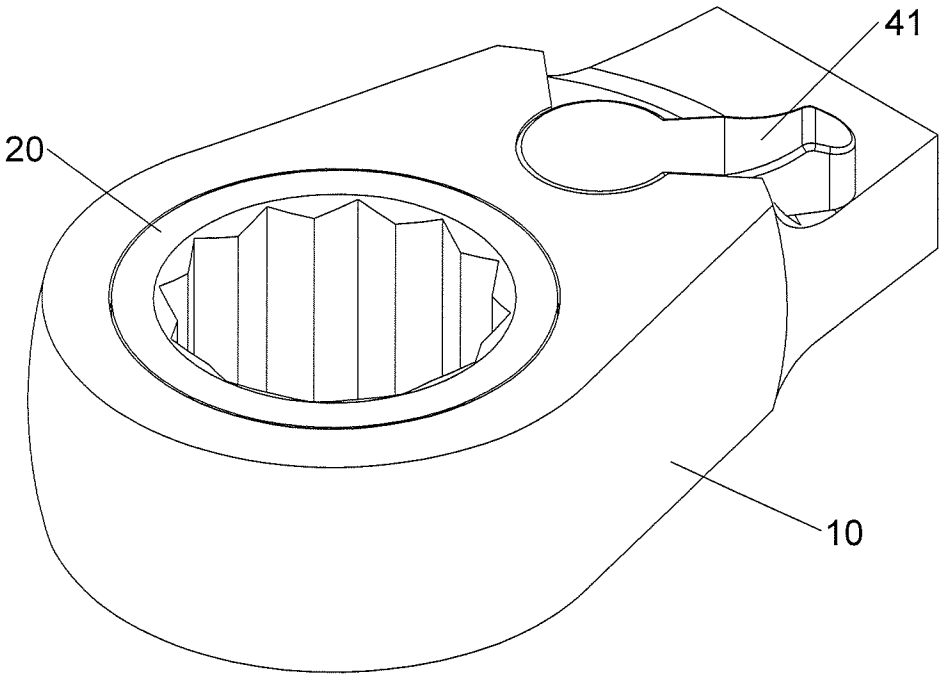
FIG. 5 is a perspective view to show the ratchet wrench of the present invention.

As shown in FIG. 5, the ratchet wheel 20 is rotatably received in the through hole 11, and the pawl 30 is received in the first recess 12. The switch member 41 is pivotably received in the second recess 13. The second face 413 of the switch member 41 contacts the first top face 16 of the body 10.

Figure 8:
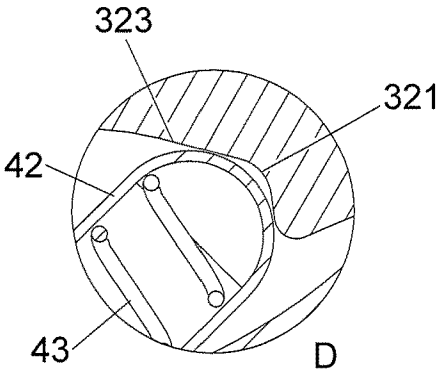
FIG. 8 is an enlarged view of the circled area "D" in FIG. 7.
Figure 7:
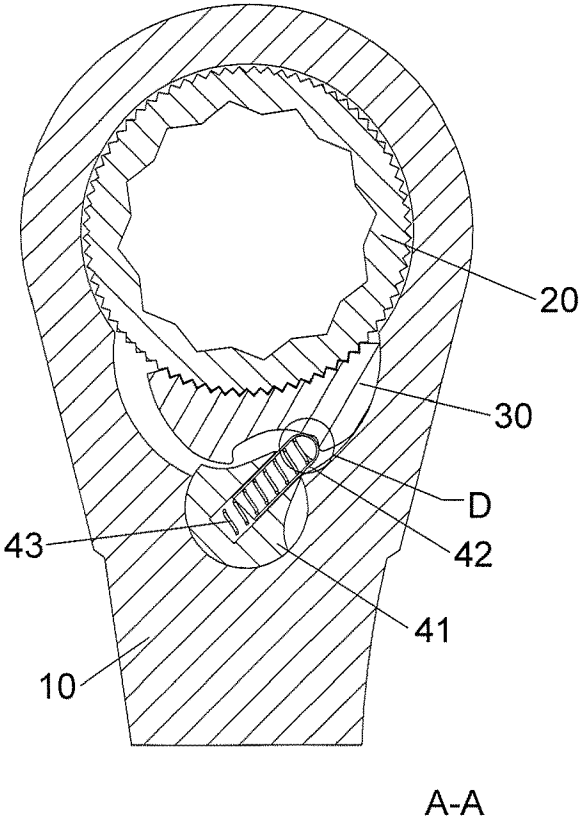
FIG. 7 is a cross sectional view, taken along line 7-7 in FIG. 6.
Figure 6:
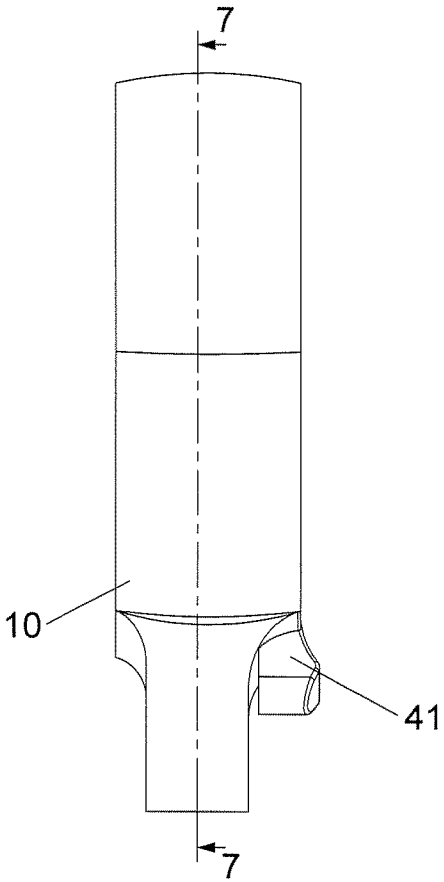
FIG. 6 is a side view to show the ratchet wrench of the present invention.

As shown in FIGS. 6 to 8, the ratchet wheel 20 is rotatably received in the through hole 11, and the pawl 30 is received in the first recess 12. The switch member 41 is pivotably received in the second recess 13. The cap 42 is biased by the resilient member 43 to contact the concaved area 32 of the pawl 30. The cap 42 is engaged with the engaging recess 321. The cap 42 contacts the second face 323, the third face 325 and the underside 34. The cap 42 is restricted by the third faces 325 from disengaging from the concaved area 32. When the user pivots the lever 414, the witch unit 40 rotates to control the movement of the pawl 30 in the first recess 12.

Figure 10:
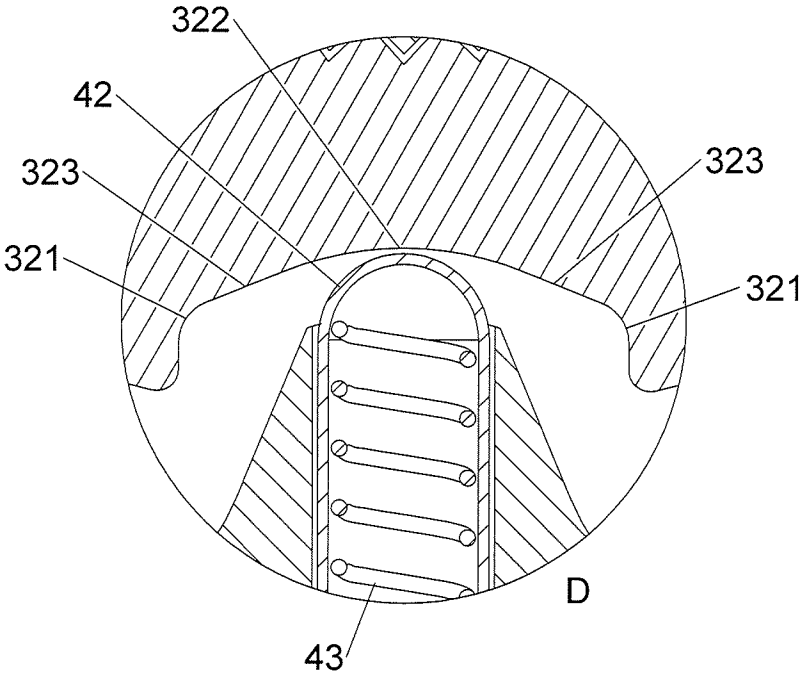
FIG. 10 is an enlarged view of the circled area "D" in FIG. 9.
Figure 9:
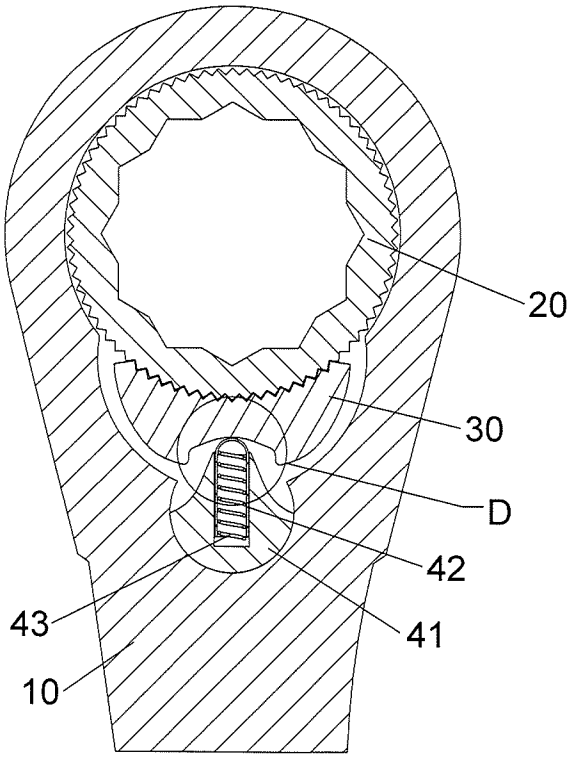
FIG. 9 is another cross sectional view, taken along line 7-7 in FIG. 6.

As shown in FIGS. 9 and 10, when pivoting the switch unit 40 to position the pawl 30 at the middle of the first recess 12, the cap 42 contacts the first face 322 of the concaved area 32, and the resilient member 43 is compressed.

Figure 12:
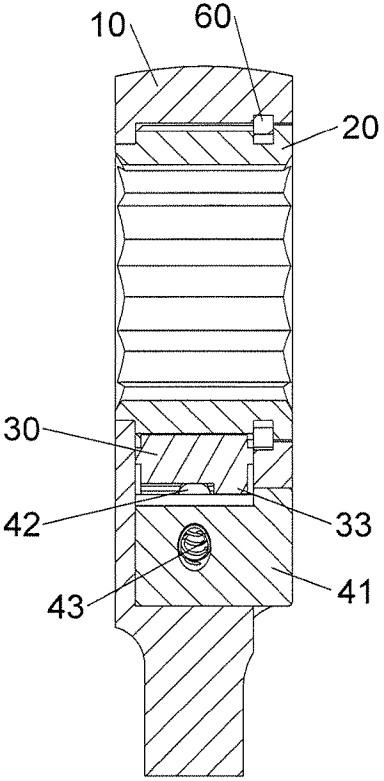
FIG. 12 is a cross sectional view, taken along line 12-12 in FIG. 11.
Figure 11:
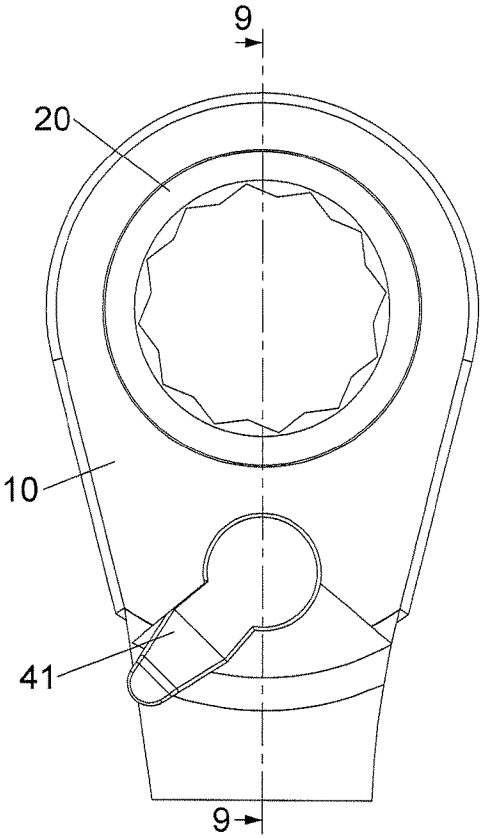
FIG. 11 is a top view of the ratchet wrench of the present invention.

As shown in FIGS. 11 and 12, the clip 60 is received in the first groove 110 and the second groove 23. The ratchet wheel 20 is restricted by the clip 60 and rotatably received in the through hole 11.

In another embodiment, the connection portion 22 is a rectangular protrusion.

In another embodiment, the first recess 12 includes an open end, and a cover is used to cover the open end.

The advantages of the present invention are that, as shown in FIG. 8, the cap 42 is biased by the resilient member 43 and contacts the concaved area 32 of the pawl 30. The cap 42 is engaged with the engaging recess 321. When the switch member 41 is pivoted, the cap 42 enters into the engaging recess 321 and is automatically positioned.

The outside of the cap 42 contacts the second face 323, the third face 325 and the underside 34. The cap 42 is restricted by the engaging recess 321 and the third face 325 to avoid the cap 42 from disengaging from the concaved area 32. The third faces 325 restrict the position of the cap 42 and effectively position the cap 42.

As shown in FIG. 10, when pivoting the switch unit 40, the pawl 30 is located at the middle portion of the first recess 12. The cap 42 contacts the first face 322 of the concaved area 32, and the resilient member 43 is compressed. The switch member 41 does not pivot unexpectedly from the status in FIG. 8 to the status in FIG. 10. That is to say, the switch unit 40 and the pawl 30 do not switch unexpectedly.

The cap 42 is biased by the resilient member 43 and contacts the concaved area 32 of the pawl 30. The cap 42 contacts the underside 34 and restricted by the underside 34. This ensures that the switch unit 40 does not separate from the second recess 13. The cap 42 is restricted by the width 36 of the protrusion 33 so that the cap 42 is located corresponding to the middle of the pawl 30. The cap 42 faces the middle of the width 35, so that the pawl 30 is perfectly engaged with the ratchet wheel 20.

Figure 3:
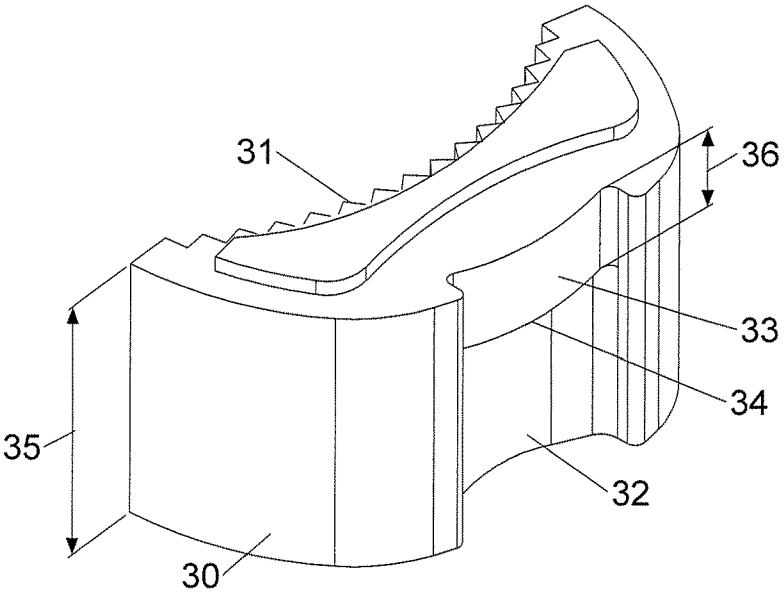
FIG. 3 is a perspective view to show the pawl of the ratchet wrench of the present invention.

As shown in FIG. 3, the protrusion 33 of the pawl 30 performs as a rib which reinforces the strength of the pawl 30. The pawl 30 can be manufactured regardless of the direction of stripping from mold set. The pawl 30 can be made by way of injection molding or powder molding.

The lever 414 is located in the recessed area 14 and has its third contact face 415 contact the first contact face 141. When pivoting the switch member 41, the fourth contact face 416 contacts the second contact face 142 so that the maximum angle that the lever 414 can be shifted is restricted. Therefore, the cap 42 does not hit the connection portion between the first recess 12 and the second recess 13, the inner periphery of the first recess 12 or the inner periphery of the second recess 13.

The second top face 413 is in flush with the first top face 16, and the lever 414 is received in the recessed area 14, so that the lever 414 is not hit when operating the ratchet wrench to unexpectedly change the rotational operations.

While we have shown and described the embodiment in accordance with the present invention, it should be clear to those skilled in the art that further embodiments may be made without departing from the scope of the present invention.

What is claimed is:

1. A ratchet wrench comprising:

a body having a through hole defined therethrough, a first recess defined in an inner periphery of the through hole, a second recess defined in an inner periphery of the first recess, the second recess communicating through a first top face of the body;

a ratchet wheel rotatably received in the through hole and having a ratchet portion defined in an outer periphery thereof, the ratchet wheel having a connection portion which is adapted to be connected to an object;

a pawl movably received in the first recess, the pawl having a toothed portion defined in a front side thereof, the toothed portion engaged with the ratchet portion of the ratchet wheel, a U-shaped concaved area defined in a rear side of the pawl, the concaved area having a first face defined in an inner periphery thereof, the first face located between two second faces which are symmetrical to the first face and tangent to the first face, the concaved area having two sidewalls and each sidewall having a third face, the first face located between two third faces which are symmetrical to the first face, an engaging recess defined between the second face and the third face on the same side relative to the first face, a first angle of 15 to 25 degrees defined between the second face and a first plane that is perpendicular to a second plane that passes through a middle point of the first face and bisects the first face, a second angle of 100 to 120 degrees defined between the second face and the third face on the same side relative to the first face, and a switch unit having a switch member which is inserted into the second recess, a cap and a resilient member received in the switch member, the cap being biased by the resilient member and engaged with one of the engaging recesses to move the pawl to either one of two ends of the first recess to be engaged with the ratchet portion to control rotational operation of the ratchet wrench.

2. The ratchet wrench as claimed in claim 1, wherein a protrusion extends from an inner end of the concaved area and includes a flat underside, a width of the protrusion is smaller than a half of a width of the pawl, an outer periphery of the cap contacts the flat underside.

3. The ratchet wrench as claimed in claim 1, wherein the switch member has a cylindrical portion which has a restriction recess which faces the concaved area of the pawl, the switch member includes a flat second top face which is in flush with the first top face of the body, a lever extends from the switch member and located in a recessed area defined in the first top face of the body, the recessed area includes a first contact face and a second contact face on two sides thereof, the lever having a third contact face and a fourth contact face on two sides thereof, when pivoting the lever to move the third contact face or the fourth face to contact the first contact face or the second contact face, the cap is biased by the resilient member to contact the concaved area, a flange extends radially from a lower portion of an inner periphery of the through hole, a first groove is defined in an upper portion of the inner periphery of the through hole, the ratchet wheel has a second groove defined in the outer periphery of an upper portion thereof, a positioning portion is formed on an underside of the ratchet wheel, the positioning portion contacts the flange, a clip is received between the first groove and the second groove to rotatably locate the ratchet wheel in the through hole.

4. The ratchet wrench as claimed in claim 1, wherein the connection portion of the ratchet wheel is a polygonal recess or a rectangular protrusion.

5. The ratchet wrench as claimed in claim 1, wherein the second face is a flat face.

6. The ratchet wrench as claimed in claim 1, wherein the first angle is 20 to 24 degrees.

7. The ratchet wrench as claimed in claim 1, wherein the third face is a flat face.

8. The ratchet wrench as claimed in claim 1, wherein the second angle is 110 to 114 degrees.

* * * * *